United States Patent [19]

Wada et al.

[11] 4,001,545

[45] Jan. 4, 1977

[54] DEVICES FOR CONTROLLING THE HEATING OF FUSER ROLL APPARATUS

[75] Inventors: Kenichi Wada, Sakai; Yuji Enoguchi, Higashiosaka; Masaya Ogawa, Sakai; Hidetoshi Kawabata, Tondabayashi; Takaji Kurita, Kawachinagano; Susumu Tanaka, Sakai; Takao Fujiwara, Sakai; Hiroshi Murasaki, Sakai, all of Japan

[73] Assignee: Minolta Camera Kabushiki Kaisha, Osaka, Japan

[22] Filed: May 28, 1975

[21] Appl. No.: 581,437

[30] Foreign Application Priority Data

June 15, 1974 Japan ..... 49-68288

[52] U.S. Cl. ..... 219/216; 100/93 RP; 219/388; 219/470; 219/471; 432/60; 432/228

[51] Int. Cl.[2] ..... G03G 15/20

[58] Field of Search ..... 219/216, 388, 469–471; 100/93 RP; 432/60, 228

[56] References Cited

UNITED STATES PATENTS

| | | | |
|---|---|---|---|
| 2,526,906 | 10/1950 | Schaab et al. | 100/93 RP |
| 3,805,020 | 4/1974 | Bates | 219/471 X |
| 3,832,524 | 8/1974 | Takiguchi | 219/216 |

FOREIGN PATENTS OR APPLICATIONS

| | | | |
|---|---|---|---|
| 1,038,208 | 6/1957 | Germany | 219/470 |
| 287,599 | 7/1931 | Italy | 219/469 |

*Primary Examiner*—C. L. Albritton

*Attorney, Agent, or Firm*—Watson, Cole, Grindle & Watson

[57] ABSTRACT

Devices for controlling the heating of fuser roll apparatus are disclosed. In fuser roll apparatus a toner powder image is heated under pressure on a supporting sheet to be fixed thereon. The apparatus comprises a plurality of heaters for heating a fuser roll; and a plurality of surface temperature detecting elements for detecting the surface temperature of the fuser roll, the power to the respective heaters being independently controlled according to detecting signals from the respective surface temperature detecting elements.

5 Claims, 8 Drawing Figures

DEVICES FOR CONTROLLING THE HEATING OF FUSER ROLL APPARATUS

BACKGROUND OF THE INVENTION

This invention relates to devices for controlling the heating of fuser roll apparatus, in which a toner powder image on a supporting sheet is heated under pressure, thereby being fixed thereon.

It is a common practice in dry type electrophotographic copying machines that an electrostatic charge of a specific polarity is uniformly charged over the entire surface of an electrophotographic sensitive plate, and then exposed to a light pattern of an original document to be reproduced, whereby an electrostatic latent image is formed on the sensitive plate. The electrostatic latent image thus formed is developed into a powder image with a developer called "toner" having a polarity opposite to that of the electrostatic latent image. The powder image thus developed is fixed on a copying paper, and thus a copy having a pattern conforming to that of the original document is obtained.

A fuser roll apparatus is one of the powder image fixing apparatus whose fixing performance is most rapid and efficient. In the fuser roll apparatus of the type described, the surface of a fuser roll is directly pressed on a toner image on the surface of the supporting sheet for heating the toner image, so that the performance of the apparatus is greatly influenced by the surface temperature of the fuser roll. For instance, where the fuser roll surface temperature is lower than a proper fixing temperature, or, to the contrary, where the surface temperature of the fuser roll is too high to fix toner image properly, there occurs in either case, transfer of toner powder image onto the surface of the fuser roll, leading to the so-called offset phenomenon, in which toner image on the surface of the fuser roll is transferred to successive copying paper during the subsequent reproduction cycle.

This necessarily narrows the allowable temperature range of the fuser roll surface, within which the proper fixing of a toner image may be effected.

The surface temperature of a fuser roll is not constant along the axial direction thereof, because of variation in the distribution of heat from a heater for heating the fuser roll, and because of heat discharge from the rotary shaft of the fuser roll to a bearing. If a surface temperature detecting element is provided in the mid portion of the fuser roll for controlling the surface temperature, there may result a lowering of temperature on the opposite end portions of the fuser roll down to a temperature lower than the critical surface temperature, due to the above-described reasons, with the resulting failure to achieve the proper fixing of a toner image.

Meanwhile, it is a recent trend to continuously produce a number of copies of different paper sizes, such as letters paper size, legal size, or computer size, from a single copying machine. Therefore, reproducing machines are designed to have a width conforming to a maximum copy size. In such a reproducing machine, when the fixing of a toner image on a copying sheet of a maximum size is effected, the surface temperature of a fuser roll becomes temporarily lowered uniformly over the entire surface thereof, while the initial surface temperature is then restored by heating the fuser roll by means of a heater. In contrast thereto, upon fixing of a toner image on a copying sheet having a width narrower than the maximum copy size, the surface temperature of the fuser roll becomes lowered only in the contacting area of the fuser roll with the copying sheet. With the temperature condition of the fuser roll being maintained, if the fuser roll is heated, there results an abnormal temperature rise in an area on the surface of the fuser roll, in which the temperature drop has not occurred, leading to uneven fixing in subsequent reproduction cycles.

In prior art reproducing machines, no satisfactory countermeasure has been devised for solving the aforesaid problems which is experienced with the continuous production of plural copies of different sizes.

SUMMARY OF THE INVENTION

It is accordingly a primary object of the present invention to provide improvements in fuser roll apparatus, in which a toner powder image on a supporting sheet is fixed.

Another object of the present invention is to provide a heating device which is capable of heating a fuser roll in a manner whereby the surface temperature of the fuser roll is maintained uniformly.

A further object of the present invention is to provide a heating device, in which a plurality of heaters are provided for heating a fuser roll.

A still further object of the present invention is to provide a heating device, in which a plurality of heaters are individually controlled.

A still further object of the present invention is to provide a device for heating a fuser roll, in which the fixing of a toner image for a plurality of supporting sheets of different copying widths is continuously effected without uneven fixing.

The above and other objects are attained by providing a plurality of heaters; a plurality of surface temperature detecting elements; and electric power controlling circuits, the respective heaters being controlled for heating a fuser roll such that the surface temperature of the fuser roll is maintained uniformly over the entire surface thereof.

The primary feature of the apparatus of the present invention resides in the provision of a plurality of heaters and a plurality of surface temperature detecting elements for detecting the surface temperature of a fuser roll which is heated by the plurality of heaters. The respective surface temperature detecting elements are disposed in opposing to respective heaters throughout the medium of the fuser roll. Electric power for the respective heaters is controlled according to the temperature detecting signals, generated from the respective detecting elements.

The above objects and features of the invention will be readily apparent from the following detailed description taken in connection with the accompanying drawings.

DETAILED DESCRIPTION OF PREFERRED EMBODIMENTS

Figure 1:
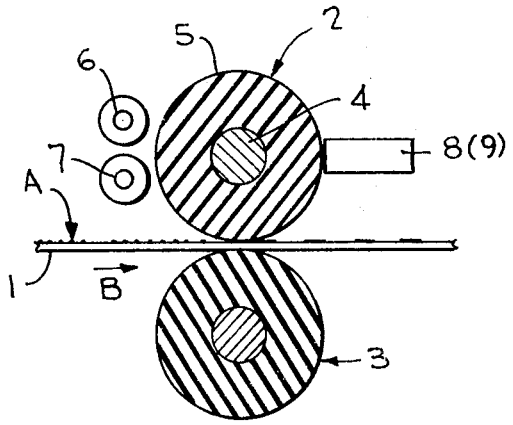
FIG. 1 is a cross-sectional view showing the primary elements of a fuser roll apparatus.
Figure 3:
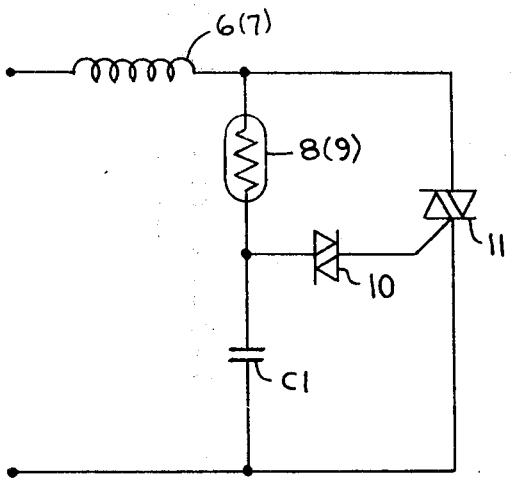
FIG. 3 is a diagram showing an electric power controlling circuit for a heater used in the apparatus of FIG. 1.
Figure 2:
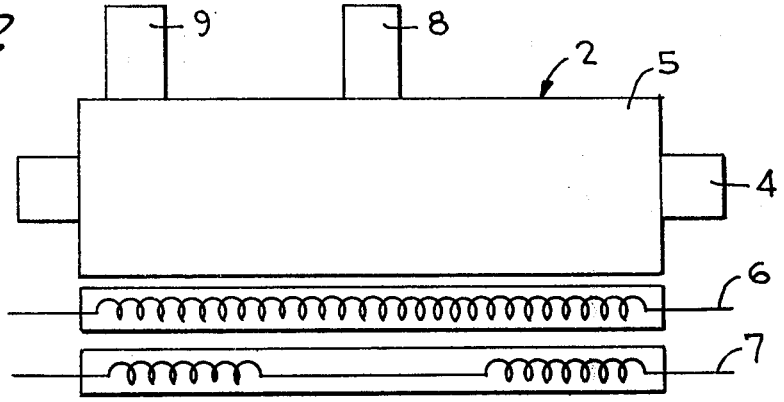
FIG. 2 is a diagrammatical plan view of the components of FIG. 1.

With reference to FIGS. 1, 2 and 3, supporting sheet 1, on the surface of which toner powder image A is supported, is heated and pressed by means of fuser roll 2 and press roll 3, whereby toner powder image A is fixed on supporting sheet 1. Fuser roll 2 has rotary shaft 4 and an outer peripheral surface coated with silicon rubber 5 surrounding rotary shaft 4. Press roll 3 is constructed the same as fuser roll 2. Fuser roll 2 is heated by heaters 6 and 7, heater 6 being adapted to uniformly heat the entire surface of fuser roll 2, and heater 7 being adapted to essentially heat the opposite end portions of fuser roll 2, as seen in FIG. 2. The surface temperature of fuser roll 2 is detected by surface temperature detecting elements 8 and 9, for example positive resistors, which are disposed in the mid portion and end portion of fuser roll 2 in contacting relation to the surface of the fuser roll, such that element 8 opposes heater 6, while element 9 opposes heater 7. The respective surface temperature detecting elements 8 and 9 are so designed as to control the electric power to the heaters by means of a temperature controlling electric circuit, as shown in FIG. 3. If a detected temperature is high, it means that the internal resistance in the surface temperature detecting elements 8 and 9 is high, and the RC time constant with respect to capacitor Cl is also high, such that an electric conductive angle to trigger TRIAC 11 by DIAC 10 is reduced, and thus electric power for heaters 6 and 7 is reduced. Where the detected temperature is low, the electric conductive angle is increased, thereby increasing the electric power for the heaters. Thus, according to the surface temperature of fuser roll 2 to which respective detecting elements 8 and 9 are maintained in contacting relation, surface temperature detecting element 8 controls, at a proper fixing temperature, heater 6 which heats the entire surface of fuser roll 2. Surface temperature detecting element 9 controls, at a proper fixing temperature, heater 7 which heats the opposite ends of fuser roll 2, which emit a greater amount of heat.

According to the present invention, by the selected positioning of a plurality of heaters and a plurality of surface temperature detecting elements disposed in opposing relation to respective heaters throughout the medium of the fuser roll, and the electric power controlling circuit, the surface temperature of fuser roll 2 is maintained at a proper uniform fixing temperature from one end to the other. In the event that a temperature variation arises as a result of the fixing of a toner image on a copying sheet, the respective surface temperature detecting elements, electric power controlling circuit and heaters are actuated in response to the temperature variation, so that either the above described offset phenomenon or uneven fixing is avoided.

Where plural copying sheets of different sizes are continuously fed for toner image fixing, if the respective heaters are so designed as to have lengths conforming to the widths of a copying sheet, then there is avoided the offset phenomenon or uneven fixing which results from the difference in width between the copying sheet used and the heating area.

Figure 4:
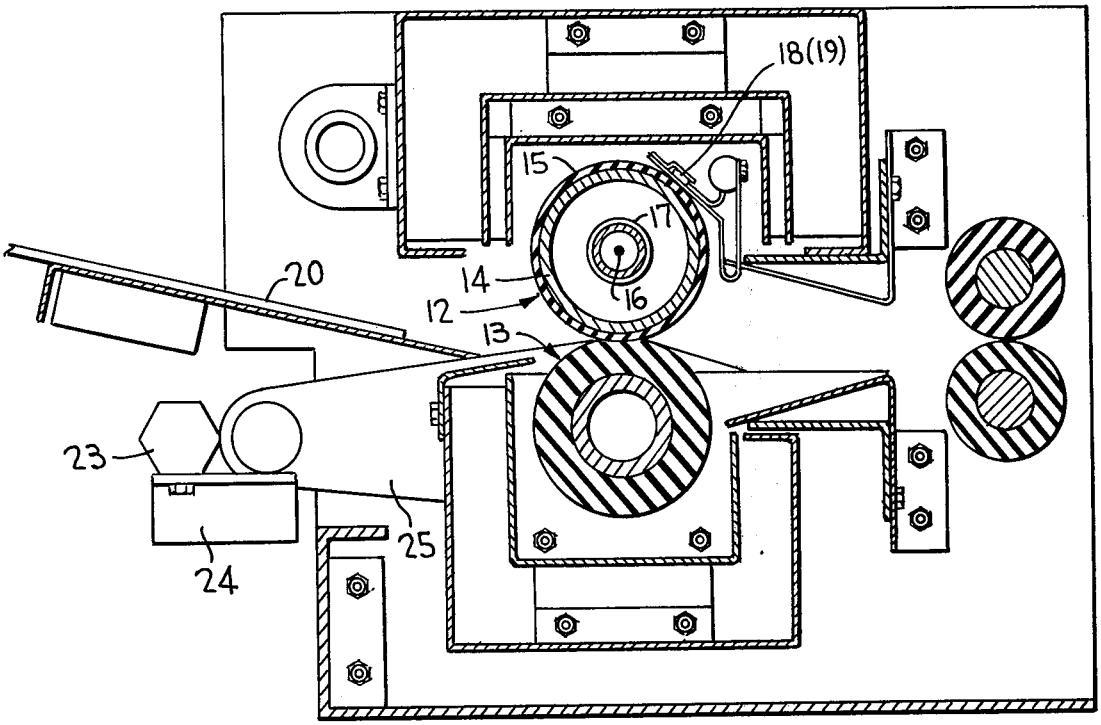
FIG. 4 is a transverse cross-sectional view of a fuser roll apparatus relating to the present invention.

FIG. 4 shows the case where the present invention is embodied in an internal heating type fuser roll apparatus. The apparatus shown in FIG. 4 is composed of fuser roll 12 and press roll 13. Fuser roll 12 has metallic sleeve 14, over the peripheral surface of which silicon rubber 15 is coated, and includes therein internal heaters 16 and 17. Surface temperature detecting elements 18 and 19, such as thermistors, are disposed in positions shown in FIG. 2 in contacting relation to the surface of fuser roll 12. Shown at 20 is a toner image supporting sheet.

Figure 5:
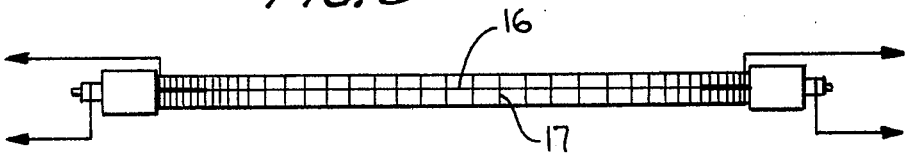
FIG. 5 shows an arrangement of two heaters in the fuser roll apparatus of the present invention.

FIG. 5 shows the physical configuration of heaters 16 and 17 of FIG. 4. Heater 16 is used for uniformly heating the central portion of fuser roll 12, while heater 17 is disposed on the outer periphery of a quartz tube of heater 16 in a manner to be biased at opposite ends of the tube, so that mainly the opposite ends of fuser roll 12 are heated.

Figure 6:
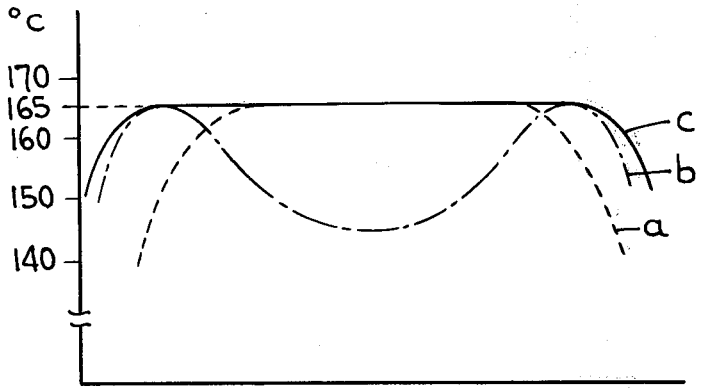
FIG. 6 is a plot of heat distribution on the surface of a fuser roll when heated by the heaters shown in FIG. 5, wherein curve *a* represents the heat distribution of one heater, curve *b* represents the heat distribution of the other heater, and curve *c* represents the heat distribution where two heaters are used simultaneously.

FIG. 6 shows a temperature distribution plot of the surface of fuser roll 12 when heated to a proper fixing temperature, for example, 165° C, by heaters 16 and 17, wherein curve *a* represents one heater 16, curve *b* represents the other heater 17, and curve *c* represents both heaters 16 and 17 used simultaneously.

Figure 7:
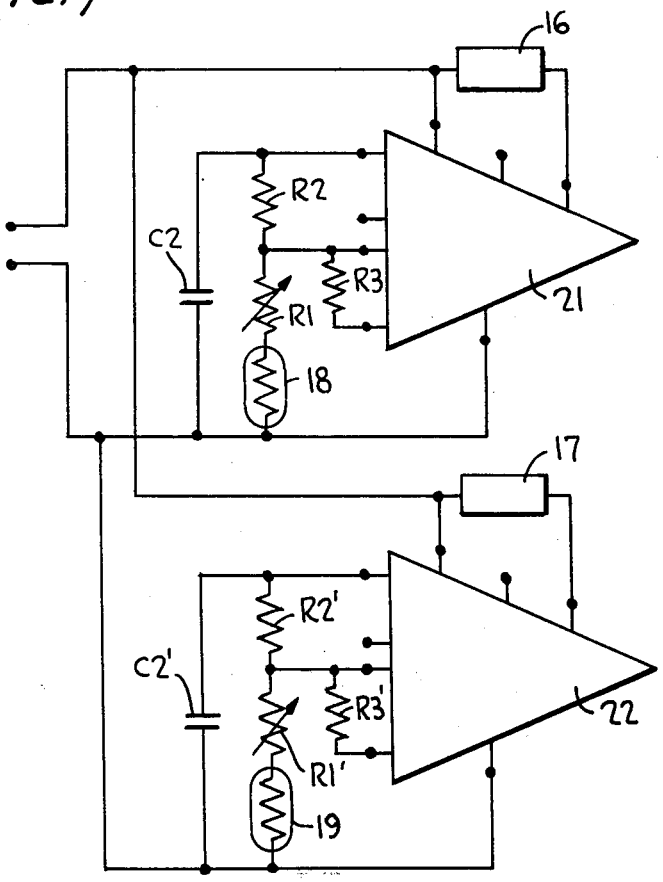
FIG. 7 is a block diagram of an electric heating control circuit incorporated in the fuser roll apparatus according to the present invention.

FIG. 7 is a diagram of an electric circuit embodying the present invention. Controlling means 21, such as STK-655, a product of Tokyo Sanyo Electric Company, which internally includes part of a bridge circuit, a differential amplifier and a TRIAC. Resistor R1 and surface temperature detecting element 18, together with resistor R2 and the resistance of controller 21, constitute a bridge circuit. The balance of the bridge circuit is lost due to variations in the resistances of temperature setting resistor R1 and surface temperature detecting element 18. The controller 21 is actuated to provide a large amount of electric power to heaters 16 and 17. Shown at C2 is a smoothening condenser, and at R3 a feedback resistor. Controller 22, resistors R1′, R2′, R3′ and capacitor C2′ are all the same in construction and function as those similar elements described above.

In operation, fuser roll 12 starts rotating, upon the starting of the machine, but the surface temperature of fuser roll 12 remains low, so that the internal resistances in respective surface temperature detecting elements 18 and 19 are high and the balance of the respective bridge circuits are lost. Thus, controller 21 is actuated thereby feeding a large amount of electric power to heaters 16 and 17. Consequently, the central area of fuser roll 12 is heated by heater 16 in a manner represented by curve *a* in FIG. 6, while the opposite end areas thereof are heated by heater 17 in a manner represented by curve *b*, respectively. Thereby, the entire surface of fuser roll 12 is heated by heaters 16 and 17 to a temperature set by resistors R1 and R1′, for example 165° C. When the surface temperature of fuser roll 12 is raised to 165° C, the internal resistances in respective surface temperature detecting elements 18 and 19 become lowered, whereas the bridge circuits in controllers 21 and 22 restore the balanced condition, and thus controllers 21 and 22 interrupt the supply of electric power to heaters 16 and 17, respectively.

In the event that the surface temperature of fuser roll 12 falls to a temperature lower than 165° C, then the respective components are operated in the manner described, and thus the surface temperature of fuser roll 12 is maintained at 165° C.

In case the surface temperature in the central area of fuser roll 12 is higher than 165° C, and the surface temperature at the opposite end areas thereof is lower than 165° C, then temperature detecting element 18 causes controller 21 to interrupt the supply of electric power to heater 16. If surface temperature detecting element 19 detects temperatures lower than 165° C, controller 22 continuously feeds electric power to heater 17, until the opposite end areas of fuser roll 12 are heated to 165° C. Heater 17 also heats the central area of fuser roll 12 as well, but the heat from the central portion of heater 17 is not sufficient to greatly raise the temperature in the central area of fuser roll 12, as seen in plot *b* in FIG. 6, so that fuser roll 12 may be maintained at the proper fixing temperature of 165° C over the entire surface thereof.

In contradistinction to the above description, where the temperature in the central area of fuser roll 12 is lower than 165° C and the temperature in the opposite end areas thereof is higher than 165° C, then surface temperature detecting element 19 causes controller 22 to interrupt the supply of electric power to heater 17, while surface temperature detecting element 18 detects temperatures lower than 165° C and causes controller 21 to feed electric power to heater 16. Thus, the central area of fuser roll 12 alone is heated, so that the temperature thereof is mantained at 165° C over the entire surface thereof.

Figure 8:
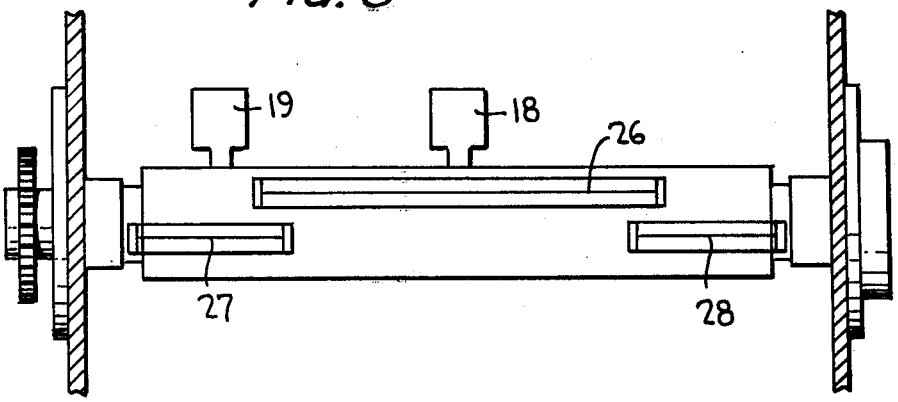
FIG. 8 illustrates another embodiment of fuser roll heating apparatus according to the present invention.

In order to eliminate heat loss due to thermal conductivity from fuser roll 12 to press roll 13, shaft 23 is rotated by a print starter switch provided separately, thereby moving levers 24 and 25, so that press roll 13 will be brought into pressure contact with fuser roll 12. Upon the termination of the fixing cycle of copying sheet 20, shaft 23 is rotated by detecting means provided separately, thereby returning levers 24 and 25 to their home positions, and thus press roll 13 will be released from fuser roll 12. FIG. 8 shows another embodiment of the present invention, wherein an externally heating type fuser roll apparatus is shown. In FIG. 8, components common to those of FIG. 4 are shown by the identical reference numerals, and the surface temperature detecting elements and electric circuits are the same as those of the first embodiment. Heater 26 heats the central area of fuser roll 12, and heaters 27 and 28 heat the opposite end portions of fuser roll 12, respectively. Heaters 26, 27 and 28 are disposed, such that the opposite ends of heater 26 overlap one end each of heaters 27 and 28, as viewed from above, and the respective heaters are controlled independently from one another. Fuser roll 12 is heated by heaters 26, 27 and 28. Temperature compensation for the opposite end portions of fuser roll 12 is effected by supplying heaters 27 and 28 with electric power higher than that of the electric power for heater 26, and thus fuser roll 12 is maintained at a constant temperature uniformly over the entire surface thereof.

While there have been described and illustrated preferred embodiments of the present invention, it is apparent that numerous alterations, omissions and additions may be made without departing from the spirit thereof.

What is claimed is:

1. Apparatus for controlling the heating of fuser roll mechanisms in an electrophotographic copying machine, comprising:

a pair of rollers including a fuser roll and a pressure roll for passage therebetween of a supporting sheet bearing toner powder image thereon;

at least first and second heating means for heating substantially the entire surface of said fuser roll to temperatures suitable for fusing the toner image on the supporting sheet, said first heating means being mounted along the axis of said fuser roll to heat at least the central portion of said fuser roll and said second heating means being mounted concentrically and transversely to the axis of said fuser roll to heat at least the end portions of said fuser roll;

at least first and second detecting means for detecting surface temperatures of said fuser roll, said first detecting means being adapted to detect the temperature of the central portion of said fuser roll and said second detecting means being adapted to detect the temperature of the end portions of said fuser roll; and control means connected to said first and second detecting means for controlling said first and second heating means individually whereby substantially the entire surface of said fuser roll is maintained at said suitable temperature.

2. Apparatus as in claim 1 wherein said control means comprises a first and second means respectively connected to said first and second detecting means which in turn are independently connected to said first and second heating means.

3. Apparatus as in claim 2 wherein said first and second control means each comprise a differential amplifier and a triac, a bridge circuit including a portion of said detecting means, whereby electric power to said first and second heating means is controlled in accordance with the unbalanced condition of said bridge circuit.

4. Apparatus as in claim 1 wherein said second heating means is mounted along the entire axis of said fuser roll with greater heating capacities concentrated at both end portions of said fuser roll than at the center portion thereof.

5. Apparatus as in claim 4 wherein said fuser roll is hollow and said first and second heating means are mounted within said fuser roll.

* * * * *